US005541699A

United States Patent [19]

Yamaguchi

[11] Patent Number: 5,541,699

[45] Date of Patent: Jul. 30, 1996

[54] AUTOMATIC FILM DEVELOPING APPARATUS

[75] Inventor: Takuji Yamaguchi, Wakayama, Japan

[73] Assignee: Noritsu Koki Co. Ltd., Wakayama, Japan

[21] Appl. No.: 420,588

[22] Filed: Apr. 12, 1995

[30] Foreign Application Priority Data

Apr. 14, 1994 [JP] Japan ..... 6-075661

[51] Int. Cl.[6] ..... G03D 3/08

[52] U.S. Cl. ..... 354/321

[58] Field of Search ..... 354/313, 319–324, 354/331, 336, 340

[56] References Cited

U.S. PATENT DOCUMENTS 5,229,802 7/1993 Shiota et al. ..... 354/340

5,231,439 7/1993 Takahashi et al. ..... 354/321 X

FOREIGN PATENT DOCUMENTS 6-35123 2/1994 Japan .

*Primary Examiner*—D. Rutledge

*Attorney, Agent, or Firm*—Armstrong, Westerman, Hattori, McLeland & Naughton

[57] ABSTRACT

An automatic film developing apparatus comprising a film drawing section for drawing out an exposed film wound in a cartridge, a developing section for developing the exposed film, a film wind-up section for winding up the developed film into the cartridge, and a cartridge conveying section for transferring the cartridge from the film drawing section to the film wind-up section. The cartridge from which the film is drawn out in the film drawing section is conveyed into the film wind-up section by the cartridge conveying section, so that the film can be securely put back into the original cartridge. Therefore, the film is not put into wrong cartridge by mistake. These film processing steps are carried out automatically, and hence the labor in the work is saved.

3 Claims, 7 Drawing Sheets

AUTOMATIC FILM DEVELOPING APPARATUS

BACKGROUND OF THE INVENTION

The present invention relates to an automatic film developing apparatus. More particularly, it relates to an automatic film developing apparatus for drawing out a film from a cartridge, developing it, and winding up the film into the cartridge automatically.

Hitherto, an exposed photographic film is drawn out of the cartridge, developed, and printed. After being printed, one film is cut into pieces of six frames each, and each piece is put into a film sheet to be returned to the customer together with the prints.

However, since the cartridge in which the film has been contained is discarded and the film is newly put into film sheet, it is a waste of resources, and the cost becomes high. In the case of extra printing, moreover, since the film has been cut, each must be conveyed into the negative mask, and it is caught in the process of conveying and the job efficiency is poor.

Recently, there have been known films wound up again in the original cartridge, but generally the operator must manually wind up the films and must search the original cartridge, which takes a lot of time, and the job efficiency is not good. Besides, when winding up a film, it might be put back into a wrong cartridge by mistake.

In the light of these circumstances, it is hence a primary object of the present invention to provide an automatic film developing apparatus capable of winding up the film surely in the cartridge, saving labor in work, and enhancing the job efficiency.

SUMMARY OF THE INVENTION

In accordance with the present invention, there is provided an automatic film developing apparatus comprising a film drawing section for drawing out an exposed film wound in a cartridge, a developing section for developing the exposed film, a film wind-up section for winding up the developed film into the cartridge, and a cartridge conveying section for transferring the cartridge from the film drawing section to the film wind-up section.

The cartridge conveying section preferably comprises a holding mechanism for elastically holding both sides of the cartridge, an elevating mechanism for moving up and down the holding mechanism and a conveying mechanism for sliding the holding and the elevating mechanisms.

According to the automatic film developing apparatus of the present invention, the concerned cartridge film is conveyed into the film drawing section by the cartridge conveying section, and the cartridge, from which the film is drawn out in the film drawing section, is transferred to the film wind-up section. This transfer is effected in the developing process of the film. These film processing steps are carried out automatically. Therefore, the film and cartridge correspond to each other surely, and labor is saved in the work performed.

DETAILED DESCRIPTION

Referring now to the accompanying drawings, an automatic film developing apparatus of the present invention is described below.

Figure 1:
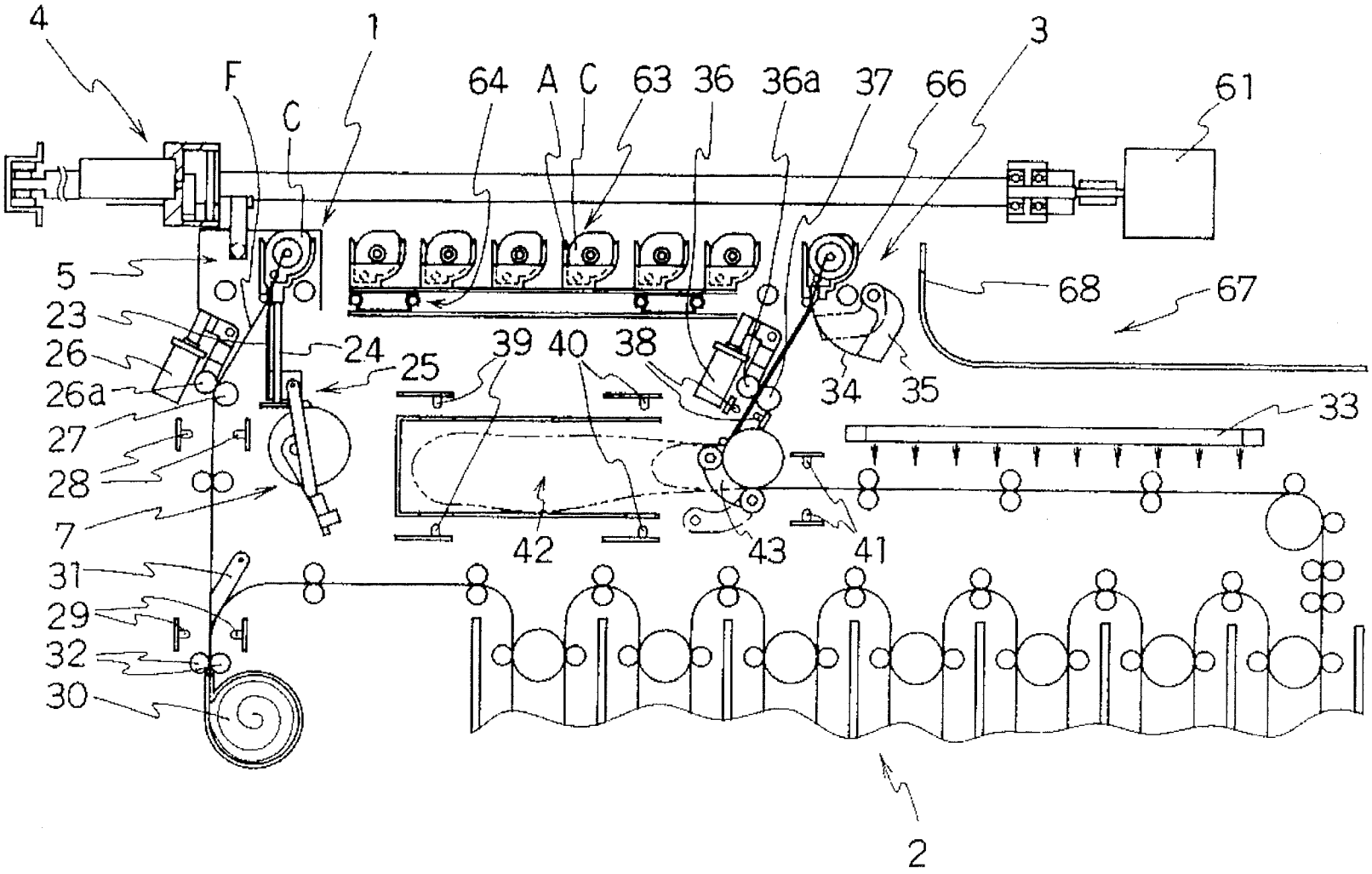
FIG. 1 is an explanatory view showing an embodiment of an automatic film developing apparatus of the present invention.

As shown in FIG. 1, the automatic film developing apparatus comprises a film drawing section 1 for drawing out an exposed film F wound in a cartridge C, a developing section 2 for developing the exposed film F, a film wind-up section 3 for winding up the developed film F into the cartridge C, and a cartridge conveying section 4 for transferring the cartridge C from the film drawing section 1 into the film wind-up section 3.

Figure 2:
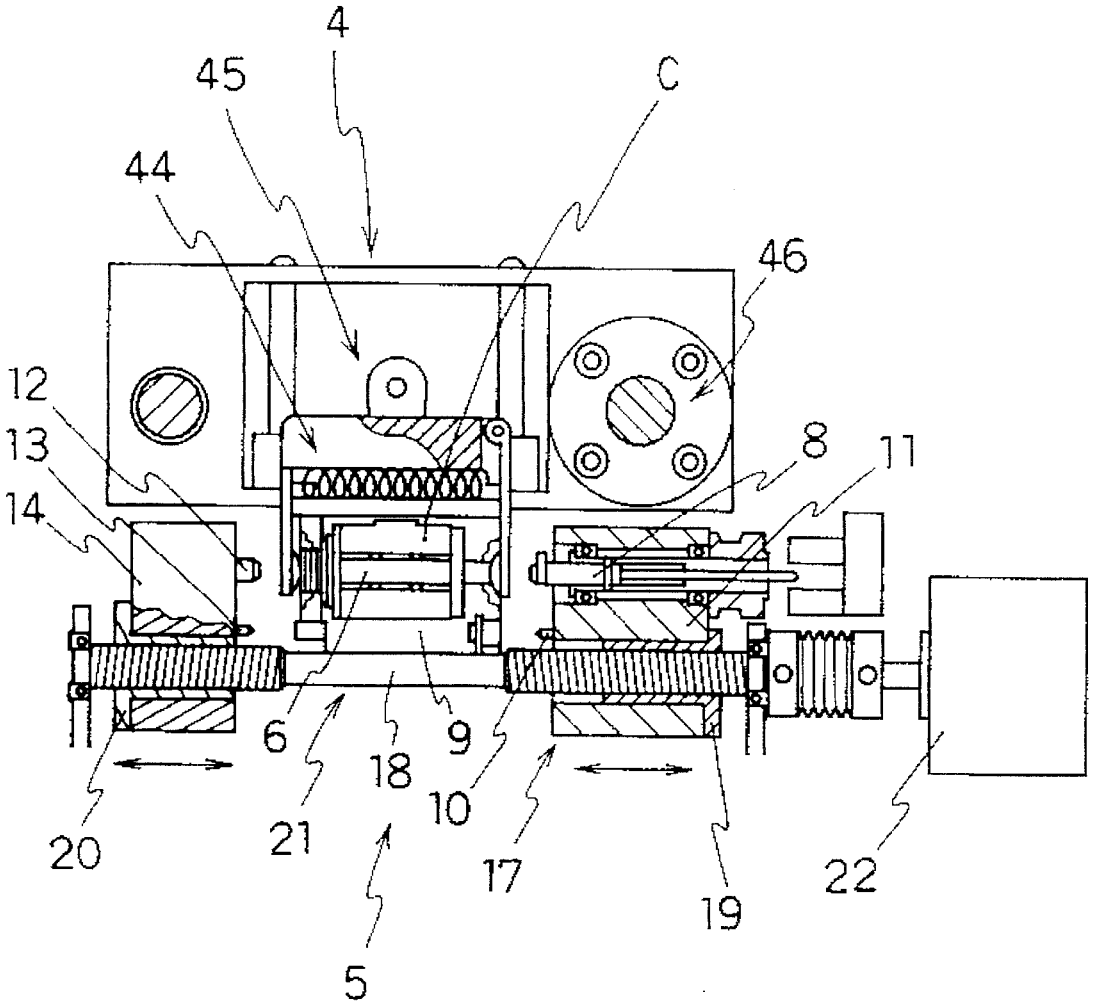
FIG. 2 is a side view of a main portion of a film drawing section, a film wind-up section, and a cartridge conveying section in the apparatus shown in FIG. 1.
Figure 3:
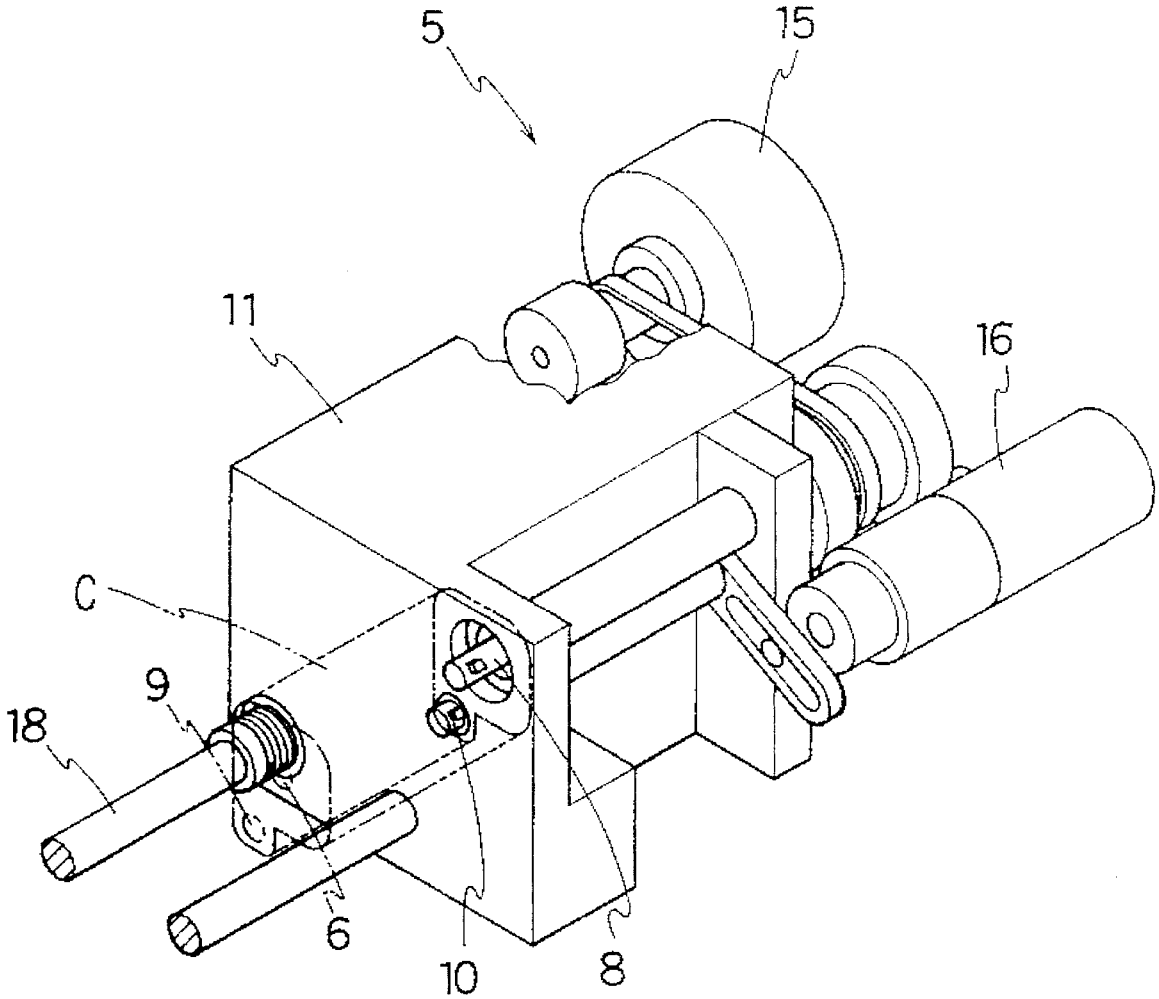
FIG. 3 is a partial perspective view of a drive mechanism in the apparatus shown in FIG. 1.

The film drawing section 1 is, as shown in FIG. 1 to FIG. 3, composed of a drive mechanism 5 for drawing out the film F from the cartridge C, and a film removal mechanism 7 for disengaging the final end of the film F from a spool 6.

The drive mechanism 5 comprises a first holding block 11 having a spool drive shaft 8 to be fitted into a key groove of the spool 6 of the cartridge C, and a door drive shaft 10 fitted into a key groove of a light shielding door 9; a second holding block 14 positioned opposite to the first holding block 11 and having a spool support shaft 12 and a door support shaft 13 for respectively holding the spool 6 and light shielding door 9; a spool drive motor 15 and a light shielding door opening and closing drive motor 16 for respectively driving the spool drive shaft 8 and door drive shaft 10; and a block moving mechanism 17 for sliding the holding blocks 11, 14 mutually in reverse directions to the spool 6.

The block moving mechanism 17 might be constituted with a ball screw 21 composed of a screw 18 having normal and reverse thread grooves cut respectively in the sides of the first and second holding blocks 11, 14 and nuts 19, 20 to be fitted in the thread grooves through a ball, and a holding block moving motor 22 for rotating and driving the screw 18. In other constitutions of the block moving mechanism, for example, holding blocks are provided in parallel parts of a timing belt wound on two pulleys so as to be moved by motors. Further, a so-called rack and pinion mechanism might be employed in which holding blocks are provided in the racks disposed so as to be engaged with a pinion on top and bottom and moved by a motor.

The film removal mechanism 7 might be constituted with an elastic piece 23 to be inserted into the cartridge C with its front end being deformed, a guide bar 24 for guiding the elastic piece 23, and a link mechanism 25 for holding the elastic piece 23 slidably on the guide bar 24.

The film drawing section 1 is equipped with a compressive solenoid 26 and a compressive roller 27, detectors 28, 29 for detecting the film F drawn out from the cartridge C, a container 30 for provisionally accommodating the film F, and a roller 32 for conveying the film F into the developing section 2 with guidance of a changeover guide 31. As the detectors 28, 29, there can be used a detector comprising a light emitting device and photo sensor.

Incidentally, the speed of drawing out the film F from the spool 6 is not synchronized with the conveying speed of the film F by the compressive roller 27 because the winding diameter of the film on the spool 6 is not constant. Hence, when drawing out the film F by the rotation of the spool 6, it is designed to cancel the drive of the compressive roller 27.

The film F conveyed in the developing section 2 is developed through a developing solution vessel, a bleaching solution vessel, a fixing solution vessel, and a stabilizing solution vessel, and is dried by a heater 33 in a drying chamber. The dried film F is sent into the film wind-up section 3.

The film wind-up part 3 is composed of the drive mechanism 5, and a film fitting lever 35 for freely rotating a tongue 34 for fitting the film F to the spool 6 in the cartridge C, by means of on a pawl of the lever 35 to be engaged with the end of the film F.

The film wind-up section 3 is also furnished with a compressive solenoid 36, a compressive roller 37, detectors 38, 39, 40, 41 for detecting the film F, a film loop unit 42 for forming the film F once in a loop, and a loop guide 43 for sending the film into the film loop unit 42. The detectors 38, 39, 40, 41 are composed of light emitting device and photo sensor.

The speed of winding up the film F by the spool 6 is not synchronized with the conveying speed of the film F by the compressive roller 37 because the film winding diameter on the spool 6 is not constant. Accordingly, when winding up the film F by the rotation of the spool 6, the drive of the compressive roller 37 is canceled. Besides, the film conveying speed in the developing section and drying chamber is constant, but the film wind-up speed by the spool 6 is not constant, same as mentioned above, and it is difficult to control the speed. Hence, to absorb the speed difference, the film is once sent into the film loop unit 42.

Figure 4:
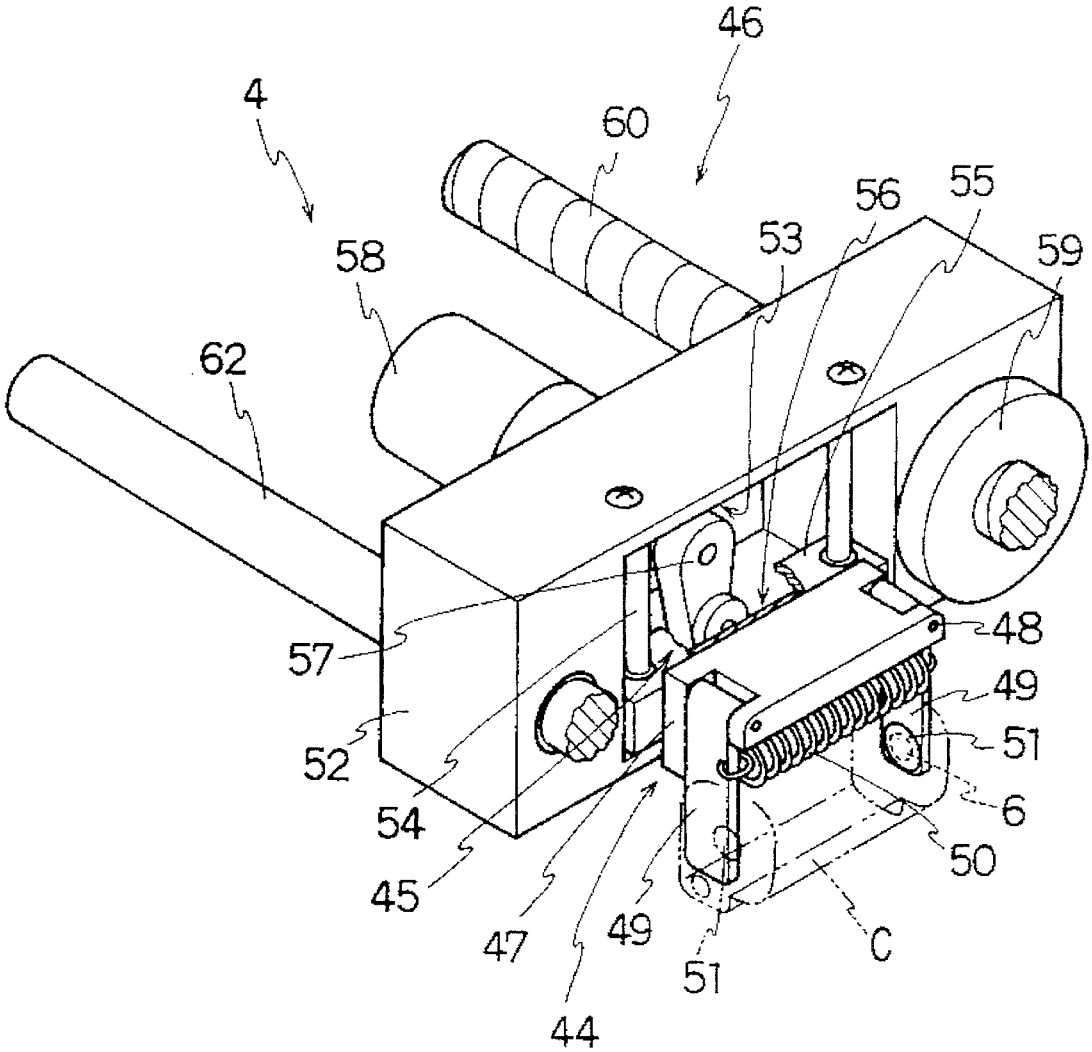
FIG. 4 is an enlarged perspective view showing the cartridge conveying section in the apparatus shown in FIG. 1.

The cartridge conveying section 4 is composed of, as shown in FIG. 2 and FIG. 4, a holding mechanism 44 for elastically holding the spool 6 of the cartridge C, an elevating mechanism 45 for moving up and down the holding mechanism 44, and a conveying mechanism 46 for sliding the mechanisms.

The holding mechanism 44 has a spring 50 attached to two holding arms 49 coupled at both sides of an elevating table 47 by means of hinge pins 48 so as to hold the cartridge C by the elastic force of the spring. In the lower part of the holding arm 49, a convex spherical part 51 is formed so as to be easily fitted into the hole of the spool 6 and easily slip out of the hole by the elastic force of the spring. As the holding method of the cartridge C, aside from the use of the elastic force of the spring, it is also possible to make use of the elastic force of the holding arm itself, for example, by fixing the holding arm directly on the elevating table.

In the elevating mechanism 45, the elevating table 47 is guided by a guide pin 54 set up in a recess 53 in a conveying block 52, and an L-shaped rotary piece 57 is inserted into an elongated hole 56 formed in the side surface 55 of the elevating table 47, and the elevating table 47 is moved up and down by rotating the L-shaped rotary piece 57 by a drive motor 58.

The conveying block 52 is moved forward and backward (to the right or to the left direction in FIG. 1), being guided by a slide shaft 62, by the conveying mechanism 46 composed of a screw 150 inserted through a nut 59, and a conveying motor 61 ( shown in FIG. 1) for rotating and driving the screw 150 normally and reversely.

As shown in FIG. 1, when a cartridge set unit 153 for setting a plurality of cartridges is disposed between the film drawing section 1 and film wind-up section 3, a specific cartridge C is picked up by the hold mechanism 44 and elevating mechanism 45 according to the instruction of the specific program memory, and is conveyed into the film drawing section 1 or film wind-up section 3 by means of the conveying mechanism 46.

In the cartridge set unit 63, meanwhile, a slide rail 64 guided by a ball is provided so as to be easy to put in and out of the automatic film developing apparatus.

The operating procedure of the apparatus according to the present invention is described below with reference to the accompanying drawings.

Figure 5:
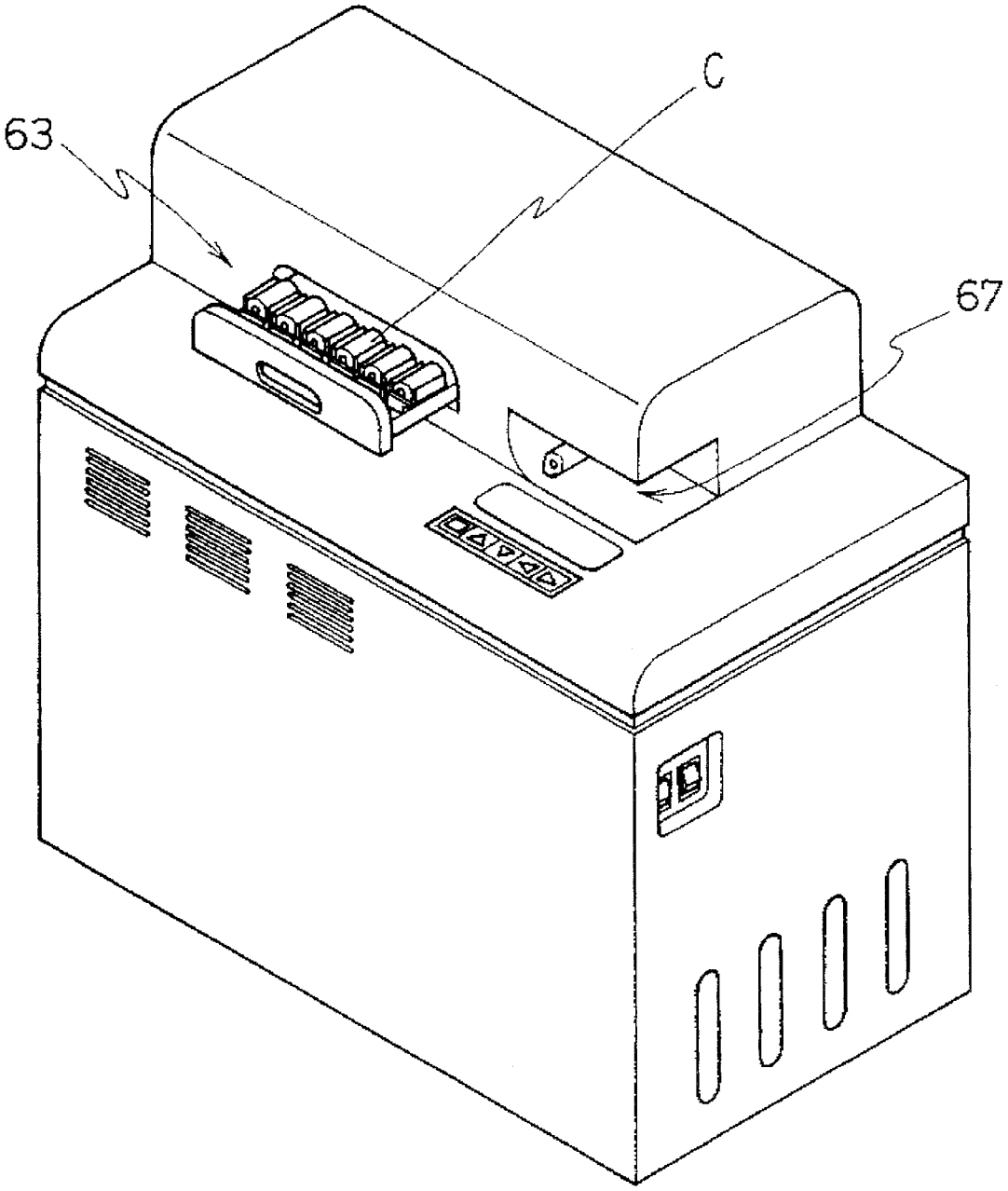
FIG. 5 is a perspective view of the automatic film developing apparatus in FIG. 1.

1. First, as shown in FIG. 5, the cartridge set unit 63 is drawn out from the automatic film developing apparatus, and a plurality of cartridges C are set therein.

2. After setting completely, the cartridge set unit 63 is pushed to be disposed in the automatic film developing apparatus.

Figure 6A:
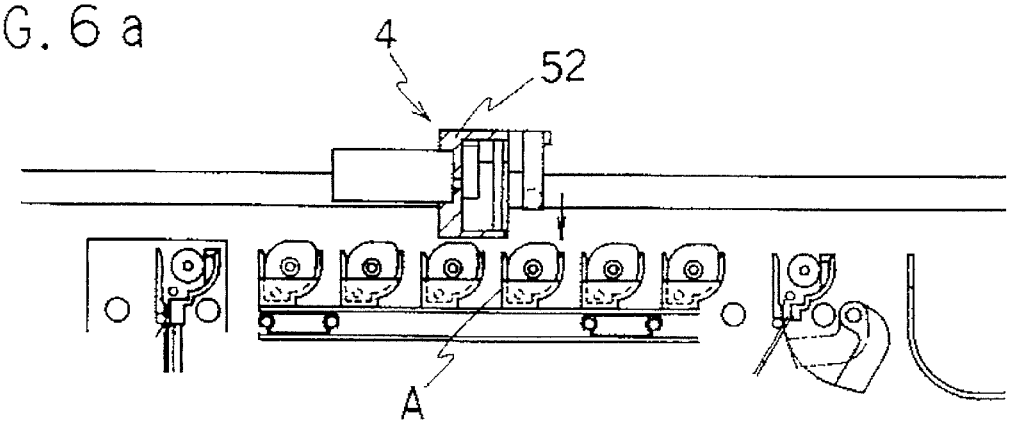
FIGS. 6*a* to 6*c* are explanatory views showing forward action of a conveying block in the cartridge conveying section shown in FIG. 1.

3. As shown in FIG. 1 and FIG. 6*a*, in the cartridge conveying section 4, the conveying block 52 of the conveying mechanism 46 moves forward to the cartridge C (for example cartridge C at position A shown in FIG. 1 and FIG. 6*a*) accommodating the specified film F to be developed in the first place by the program memory.

Figure 6B:
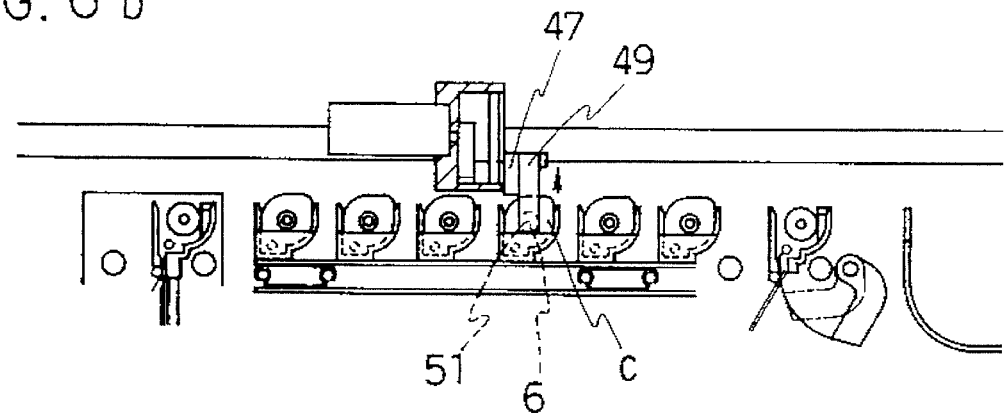

4. Then, as shown in FIG. 6*b*, the elevating table 47 is lowered, and the holding arm 49 is pushed to open, and the convex spherical part 51 is fitted into the hole of the spool 6 of the cartridge C, thereby gripping the cartridge.

Figure 6C:
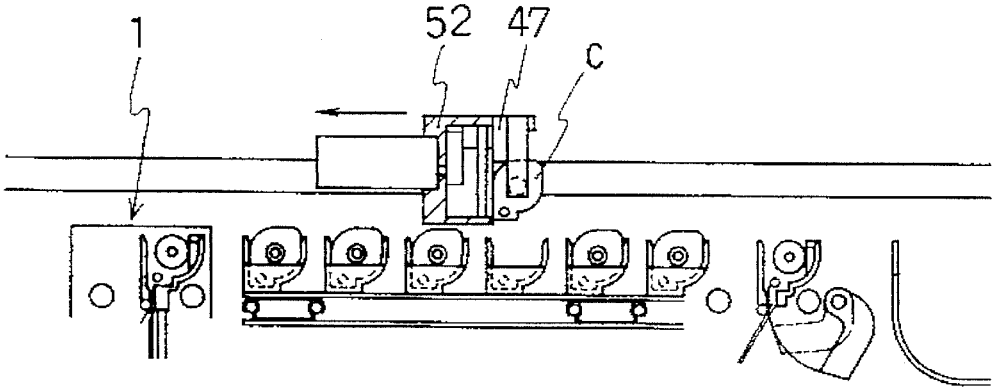
Figure 7A:
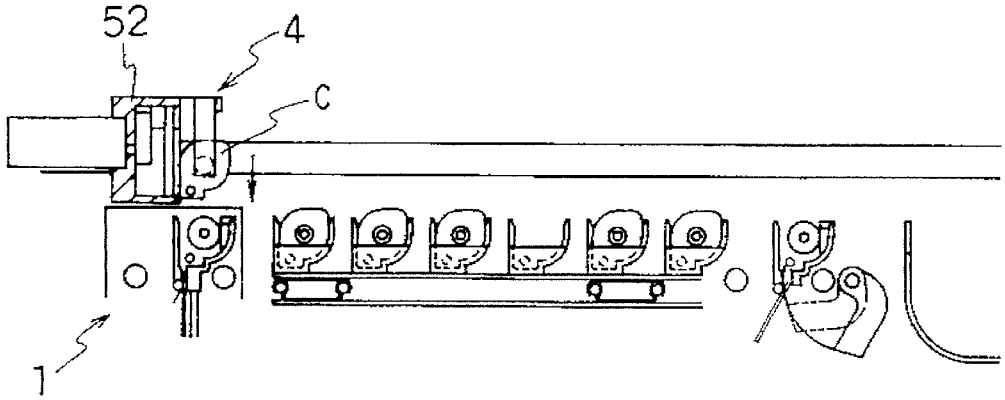
FIGS. 7*a* to 7*c* are explanatory views showing backward action of the conveying block shown in FIG. 6.

5. Next, as shown in FIG. 6*c* and FIG. 7*a*, after elevating the elevating table 47, the conveying block 52 holding the cartridge C is moved backward to the film drawing section 1.

Figure 7B:
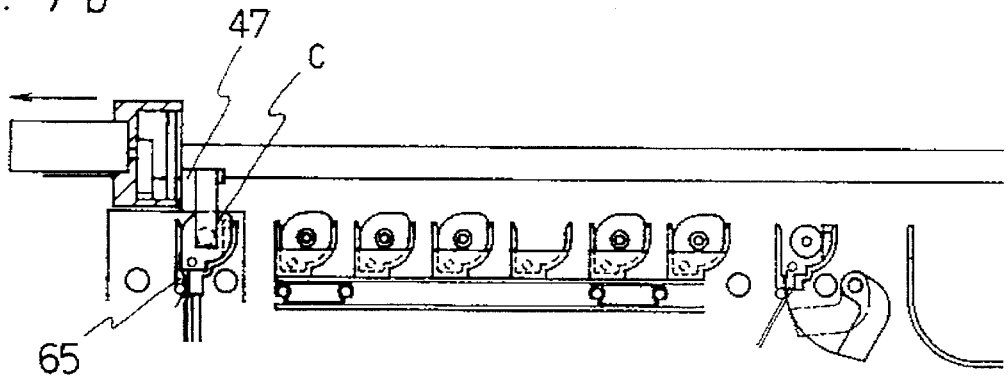

6. As shown in FIG. 7*b*, consequently, the elevating table 47 is lowered, and the cartridge C is set in the cartridge holder 65.

Figure 7C:
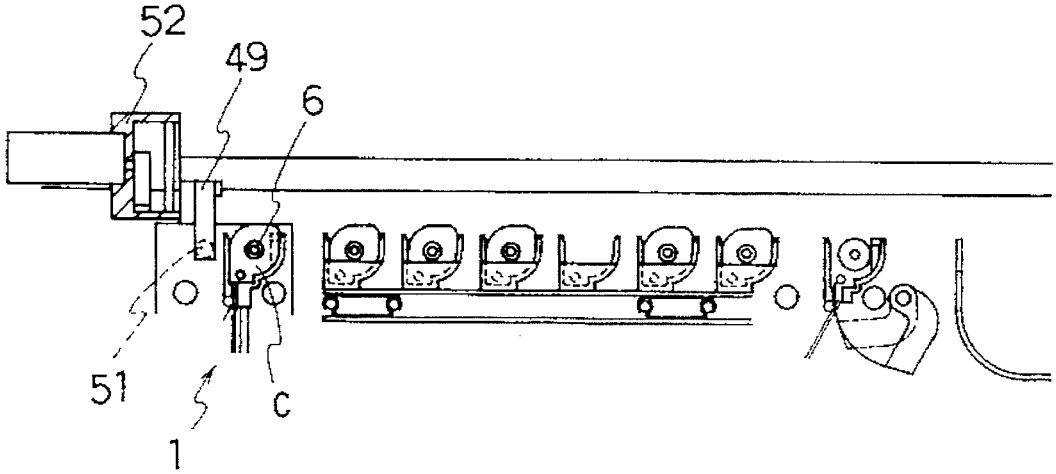

7. Thereafter, as shown in FIG. 7*c*, the conveying block 52 is further moved backward. As a result, the convex spherical part 51 slips out of the hole in the spool 6, so that the cartridge C is disengaged from the holding arm 49.

8. When the cartridge C is completely loaded into the film drawing section 1, the first and second holding blocks 11, 14 are moved by the block moving mechanism 17 of the drive mechanism 5, and the spool drive shaft 8, door drive shaft 10, spool support shaft 12 and door support shaft 13 are inserted into the respective holes in the spool 6 of cartridge C and light shielding door 9, thereby holding the cartridge C.

9. Afterwards, driving the spool drive shaft 8 and door drive shaft 10, the keys of the shafts are fitted into the key groove in the spool 6 and the key groove in the light shielding door 9, respectively.

10. By the key coupling, the light shielding door 9 is opened at first, then the spool 8 is rotated to draw out the film F from the cartridge C.

11. As shown in FIG. 1, when the front end of the drawn film F is detected by the detector 28, the power source of the spool drive motor 15 is turned of, and the rotation of the spool 6 is set free.

12. By actuating the compressive solenoid 26, the film F is compressed by the roller 26a of the compressive solenoid 26 and the compressive roller 27, and the film F is conveyed into the container 30 for temporary storage by means of the compressive roller 27.

13. When the detector 28 detects the rear end mark of the film F, feeding of the film F is stopped.

14. The elastic piece 23 of the film removal mechanism 7 is inserted into the cartridge C, and the rear end of the film F is taken out of the spool 6.

15. When the film F is taken out, the film F is conveyed again.

16. When the output of the detector 29 is changed from "present" to "absent" of the film F, it is judged to be the rear end of the film F, and conveying of the film F is stopped temporarily.

17. To convey the film F into the developing section 2 from the rear end of the film F, after moving the changeover guide 31, the film F is conveyed in the reverse direction by the roller 32. Then, by way of the processing vessels and drying chamber in the developing section 2, the film F is conveyed into the film wind-up section 3.

18. After the film is once completely drawn out from the cartridge C, the block moving mechanism 17 is actuated to draw out the shafts such as the spool drive shaft 8 in the first and second holding blocks 11, 14 from the holes in the spool 6 and light shielding door 9.

19. The conveying block 52 is moved forward onto the cartridge C.

20. Then the conveying table 47 is moved up and down, and the cartridge C is picked up by the holding arm 49.

21. The conveying block 52 is further moved forward, and the cartridge C is conveyed to the film wind-up section 3, and is set in the cartridge holder 66 shown in FIG. 1.

22. In the midst of repetition of the above operation, if there is a cartridge C in the cartridge holder 66, the conveyed cartridge C is conveyed to the initial position of the cartridge set unit 63.

23. When the cartridge C is completely loaded into the film wind-up unit 3, in succession to operations 8 and 9, the light shielding door 9 is opened and the angle of the spool 6 is determined.

24. After an elapse of a predetermined time after the detector 38 detects the film F sent out from the developing section 2, when the front end of the film F is sent up to the compressive roller 37, the compressive solenoid 36 is actuated, and the film F is compressed by the roller 36*a* of the compressive solenoid 36 and the compressive roller 37 which is not driven.

25. Afterwards, opening the loop guide 43, the film F being conveyed is continuously directed into the film loop unit 42.

26. When the detector 39 detects the film F, the compressive roller 37 is driven for a predetermined time, and the film F is conveyed until its front end is caught in the tongue 34 of the film fitting lever 35.

27. When the film fitting lever 35 is driven, the compressive solenoid 36 is simultaneously separated from the compressive roller 37, and the film F is caught on the tongue 34, and is stopped in the axial groove of the spool 6 of the cartridge C.

28. Then, the spool 6 is rotated to wind-up the film F.

29. When the detector 40 judges that the film F is "absent", wind-up of the spool 6 is stopped temporarily, and when the detector 39 judges that the film F is "present" in the film loop unit 42, the spool 6 winds up the film F. When the detector 41 judges the film F conveying to be "absent," the spool 6 winds up continuously.

30. The film F is wound up further, and when the detector 38 judges the film F to be "absent" after detecting the end of the film F, winding up of a predetermined time is carried out to completely put the film F into the cartridge C.

31. After putting the film F into the cartridge C, the light shielding door 9 is closed.

32. Afterwards, the first and second holding blocks 11, 14 holding the cartridge C are moved, and the inserted spool drive shaft 8 and other shafts are removed.

33. The elevating table 47 of the conveying block 52 in the film wind-up section 3 is lowered and raised, and the cartridge C is picked up from the cartridge holder 66 by the holding arm 49.

34. Then the conveying block 52 is moved up to the cartridge conveying section 67.

35. In the conveying section, the elevating table 47 is lowered while the conveying block 52 is moved slightly backward. Consequently, to be engaged with a discharge wall 68, the cartridge C is pushed out of the holding arm 49, and is sent out into a cartridge discharging unit 67 as shown in FIG. 5.

In this procedure of operation, the sequentially developed film is put back into the original cartridge and is discharged.

As described herein, according to the automatic film developing apparatus of the present invention, the cartridge from which the film is drawn out in the film drawing section is conveyed into the film wind-up section by the cartridge conveying section, so that the film can be surely put back into the original cartridge. Therefore, the film is not put into wrong cartridge by mistake. These film processing steps are carried out automatically, and hence the labor in the work is saved. It is possible to operate continuously without interrupting the film processing only by setting plural cartridges at a time, the time of the operator for handling the apparatus is shortened. Besides, the waiting time for next job is minimized. Hence the job efficiency can be notably enhanced.

Moreover, the apparatus is simplified because it does not require such mechanism as to detect and collate the ID number such as bar code marked on the cartridge and film.

Though several embodiments of the present invention are described above, it is to be understood that the present invention is not limited only to the above-mentioned and various changes and modifications may be made in the invention without departing from the spirit and scope thereof.

What is claimed is:

1. An automatic film developing apparatus comprising a film drawing section for drawing out an exposed film wound in a cartridge, a developing section for developing the exposed film, a film wind-up section for winding up the developed film into the cartridge, and a cartridge conveying section for transferring the cartridge from the film drawing section to the film wind-up section, wherein the cartridge conveying section comprises a holding mechanism for elastically holding both sides of the cartridge, an elevating mechanism for moving up and down the holding mechanism, and a conveying mechanism for moving the holding and elevating mechanisms.

2. An automatic film developing apparatus according to claim 1 in which said conveying mechanism includes a slideway extending from said film drawing section to said film wind-up section, said holding mechanism includes a conveying block mounted for sliding movement on said slideway, a pair of opposed, elastically spreadable arms pivotally attached with respect to said conveying block and adapted to resiliently engage a cartridge at opposite ends thereof for releasably connecting said cartridge to said conveying block, and means for moving said conveying block on said slideway in opposite directions between said film drawing section and said film wind-up section.

3. An automatic film developing apparatus according to claim 2 in which said elevating mechanism comprises an elevating table mounted for guided vertical movement on said conveying block, means on said elevating table for pivotally attaching said arms, and means carried by said conveying block for selectively moving said elevating table upwardly and downwardly.

* * * * *